US009528392B2

(12) United States Patent
Casavant et al.

(10) Patent No.: US 9,528,392 B2
(45) Date of Patent: Dec. 27, 2016

(54) SYSTEM FOR SUPPORTING A TURBINE NOZZLE

(71) Applicant: General Electric Company, Schenectady, NY (US)

(72) Inventors: Matthew Stephen Casavant, Greenville, SC (US); Kenneth Damon Black, Travelers Rest, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 741 days.

(21) Appl. No.: 13/891,441

(22) Filed: May 10, 2013

(65) Prior Publication Data

US 2014/0334925 A1 Nov. 13, 2014

(51) Int. Cl.
*F01D 25/24* (2006.01)
*F01D 11/00* (2006.01)

(52) U.S. Cl.
CPC ..... *F01D 25/246* (2013.01); *F01D 11/001* (2013.01)

(58) Field of Classification Search
CPC ..... F01D 25/24; F01D 25/243; F01D 25/246; F01D 25/28; F01D 11/001; F05D 2240/14; F05D 2240/128; F05D 2260/30; F02C 7/12; F02C 7/20
See application file for complete search history.

(56) References Cited

U.S. PATENT DOCUMENTS

| | | | | |
|---|---|---|---|---|
| 5,211,536 | A | 5/1993 | Ackerman et al. | |
| 5,343,694 | A | 9/1994 | Toborg et al. | |
| 5,372,476 | A | 12/1994 | Hemmelgarn et al. | |
| 5,441,385 | A | 8/1995 | Boyd et al. | |
| 6,343,463 | B1 * | 2/2002 | Mei | F01D 25/246 415/115 |
| 7,160,078 | B2 | 1/2007 | Coign et al. | |
| 8,070,427 | B2 | 12/2011 | Snook et al. | |
| 2007/0154305 | A1 * | 7/2007 | Arness | F01D 9/041 415/209.2 |
| 2010/0242487 | A1 * | 9/2010 | Davis, Jr. | F01D 9/023 60/772 |
| 2011/0189008 | A1 | 8/2011 | Brunt et al. | |
| 2011/0271654 | A1 | 11/2011 | Siden | |
| 2012/0210722 | A1 * | 8/2012 | Hynum | F01D 5/081 60/772 |

* cited by examiner

*Primary Examiner* — Gregory Anderson
*Assistant Examiner* — Maxime Adjagbe
(74) *Attorney, Agent, or Firm* — Dority & Manning, PA

(57) ABSTRACT

A system for supporting a turbine nozzle includes an inner barrel having a forward end, an aft end and an outer surface that extends between the forward end and the aft end. A first fitting that extends through the outer surface is defined within the inner barrel. The system further includes a nozzle support ring that defines a second fitting that is complementary to the first fitting defined within the inner barrel.

12 Claims, 5 Drawing Sheets

SYSTEM FOR SUPPORTING A TURBINE NOZZLE

FIELD OF THE INVENTION

The present invention generally involves a gas turbine. More specifically, the invention relates to a system for supporting a turbine nozzle disposed within the gas turbine.

BACKGROUND OF THE INVENTION

A combustion section of a gas turbine generally includes a plurality of combustors that are arranged in an annular array around an outer casing such as a compressor discharge casing. Compressed air flows from a compressor to the compressor discharge casing and is routed to each combustor. Fuel from a fuel nozzle is mixed with the compressed air in each combustor to form a combustible mixture within a primary combustion zone of the combustor. The combustible mixture is burned to produce hot combustion gases having a high pressure and high velocity. The combustion gases are routed along a hot gas path defined within the compressor discharge casing towards a first stage of stationary turbine nozzles that are mounted upstream from and/or adjacent to an inlet of a turbine. The combustion gases flow across the turbine nozzles which direct the combustion gases across a stage of turbine blades which are connected to a shaft. Thermal and kinetic energy are transferred from the combustion gases to the turbine blades to cause the shaft to rotate, thereby producing mechanical work. For example, the turbine may be coupled to a shaft that drives a generator to produce electricity.

In particular gas turbine designs, a system for supporting the first stage of turbine nozzles includes an inner barrel or diffuser casing that extends downstream from the compressor within the compressor discharge casing. The diffuser casing defines a flow path for routing the compressed air between the compressor and the compressor discharge casing. A nozzle support ring is bolted to an aft portion of the diffuser casing and extends axially and/or radially between the diffuser casing and the first stage of turbine nozzles to provide mounting support for the turbine nozzles.

As power output requirements of gas turbines continue to increase, the size or overall footprint of the gas turbines also increases. This requires larger facilities to accommodate the larger gas turbines and may increase costs associated with and/or prohibit replacing existing gas turbines with newer designs. As a result, designers are tasked with balancing size, particularly the axial length, of newer gas turbines with the increased power output requirements. One area of the gas turbine that may be shortened while maintaining desired power output and overall efficiency of the gas turbine is the combustion section. However, a shorter diffuser may compromise compressor efficiency. As a result, it is preferable to shorten the axial length between the aft portion of the diffuser and the first stage turbine nozzles, thereby rendering existing support schemes less than optimal. As a result, an improved system for supporting the first stage of turbine nozzles which accommodates for the shorter combustion section would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supporting a stage of turbine nozzles. The system includes an inner barrel having a forward end, an aft end and an outer surface that extends between the forward end and the aft end. A first fitting defined within the inner barrel extends through the outer surface of the inner barrel. The system further includes a nozzle support ring that defines a second fitting that is complementary to the first fitting defined within the inner barrel.

Another embodiment of the present invention is a combustion section of a gas turbine. The combustion section includes a compressor discharge casing, a turbine nozzle that is disposed within the compressor discharge casing and an inner barrel that is axially separated from the turbine nozzle within the compressor discharge casing. The inner barrel includes a forward end, an aft end and an outer surface that extends between the forward end and the aft end. A first fitting is defined within the inner barrel proximate to the aft end. The first fitting extends through the outer surface. The combustion section further includes a nozzle support ring having a forward portion and an aft portion. The forward portion defines a second fitting that is complementary to the first fitting. The second fitting is engaged with the first fitting and the aft portion is engaged with the turbine nozzle.

The present invention may also include a gas turbine. The gas turbine generally includes a compressor, a combustion section disposed downstream from the compressor, a turbine disposed downstream from the combustion section and a turbine nozzle disposed at an inlet to the turbine. The combustion section generally includes a compressor discharge casing that circumferentially surrounds a system for supporting the turbine nozzle. The system comprises an inner barrel that extends within the compressor discharge casing where the inner barrel is axially separated from the turbine nozzle. The inner barrel includes a forward end, an aft end and an outer surface that extends between the forward end and the aft end. A first fitting is defined within the inner barrel proximate to the aft end and extends through the outer surface. The system further includes a nozzle support ring having a forward portion and an aft portion where the forward portion defines a second fitting that is complementary to the first fitting. The second fitting is engaged with the first fitting and the aft portion of the nozzle support ring is engaged with the turbine nozzle.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
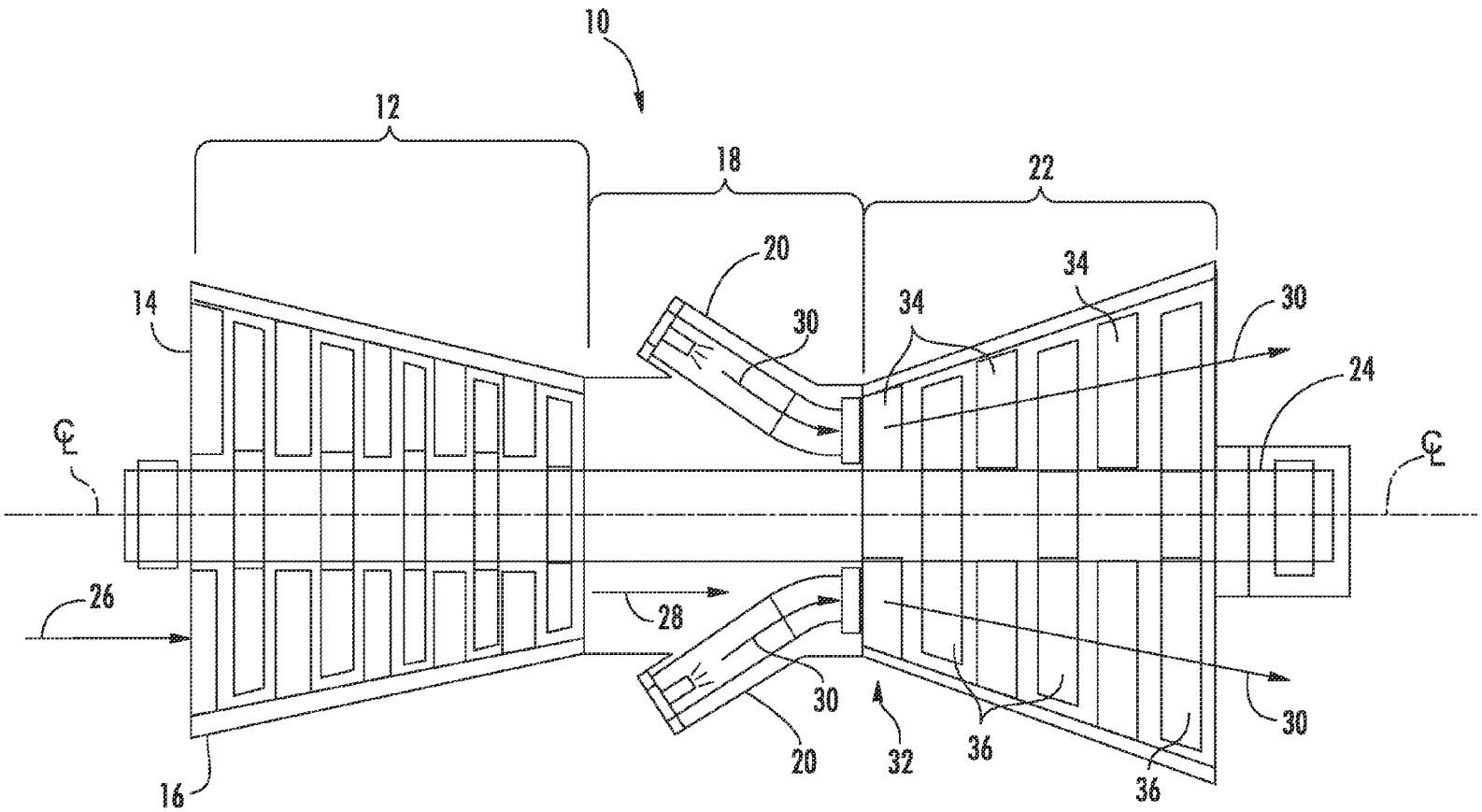
FIG. 1 provides an example of a gas turbine as may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of an industrial gas turbine for purposes of illustration, one of ordinary skill in the art will readily appreciate that embodiments of the present invention may be applied to any turbomachine and is not limited to an industrial gas turbine unless specifically recited in the claims.

Referring now to the drawings, wherein like numerals refer to like components, FIG. 1 illustrates an example of a gas turbine 10 as may incorporate various embodiments of the present invention. As shown, the gas turbine 10 generally includes a compressor section 12 having an inlet 14 disposed at an upstream end of the gas turbine 10, and a casing 16 that at least partially surrounds the compressor section 12. The gas turbine 10 further includes a combustion section 18 having a combustor 20 downstream from the compressor section 12, and a turbine section 22 downstream from the combustion section 18. A shaft 24 extends axially through the gas turbine 10. As shown, the combustion section 18 may include a plurality of the combustors 20.

In operation, air 26 is drawn into the inlet 14 of the compressor section 12 and is progressively compressed to provide a compressed air 28 to the combustion section 18. The compressed air 28 flows into the combustion section 12 and is mixed with fuel in the combustor 20 to form a combustible mixture. The combustible mixture is burned in the combustor 20, thereby generating a hot gas 30 that flows from the combustor 20 across a first stage 32 of turbine nozzles 34 and into the turbine section 22. The hot gas rapidly expands as it flows through alternating stages turbine blades 36 and turbine nozzles 34 disposed within the turbine section 22 along an axial centerline of the shaft 24. Thermal and/or kinetic energy is transferred from the hot gas to each stage of the turbine blades 36, thereby causing the shaft 24 to rotate and produce mechanical work. The shaft 24 may be coupled to a load such as a generator (not shown) so as to produce electricity. In addition or in the alternative, the shaft 24 may be used to drive the compressor section 12 of the gas turbine.

Figure 2:
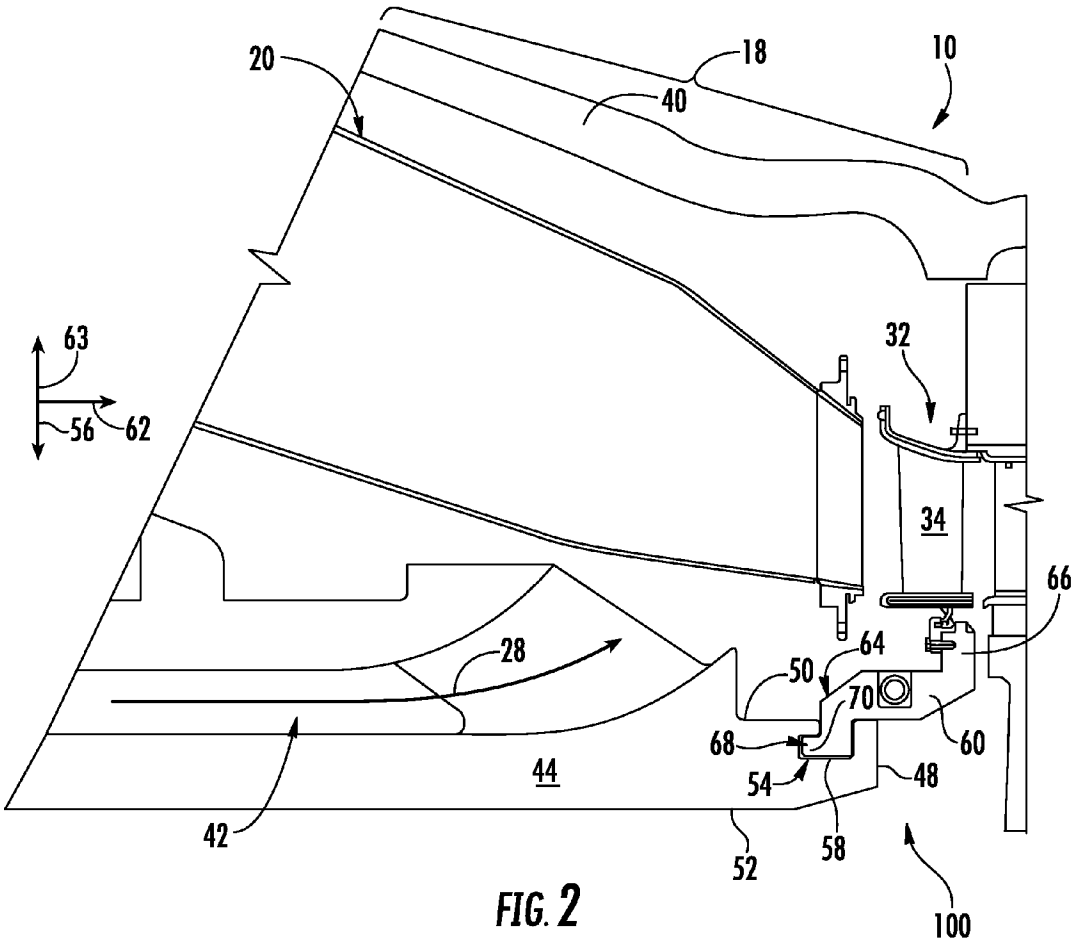
FIG. 2 provides an enlarged cross section side view of a portion of the gas turbine as shown in FIG. 1, according to at least one embodiment of the present invention.

FIG. 2 provides an enlarged cross section side view of a portion of the gas turbine 10 as shown in FIG. 1, including a portion of the combustion section 18 according to at least one embodiment of the present invention. As shown in FIG. 2, a compressor discharge casing 40 or other outer casing surrounds the combustor 20. A diffuser 42 is disposed within the compressor discharge casing 40. The diffuser 42 routes the compressed air 28 from the compressor section 12 into the compressor discharge casing 40. The diffuser 42 is at least partially defined by an inner barrel 44 that extends circumferentially around the shaft 24 (FIG. 1).

Figure 3:
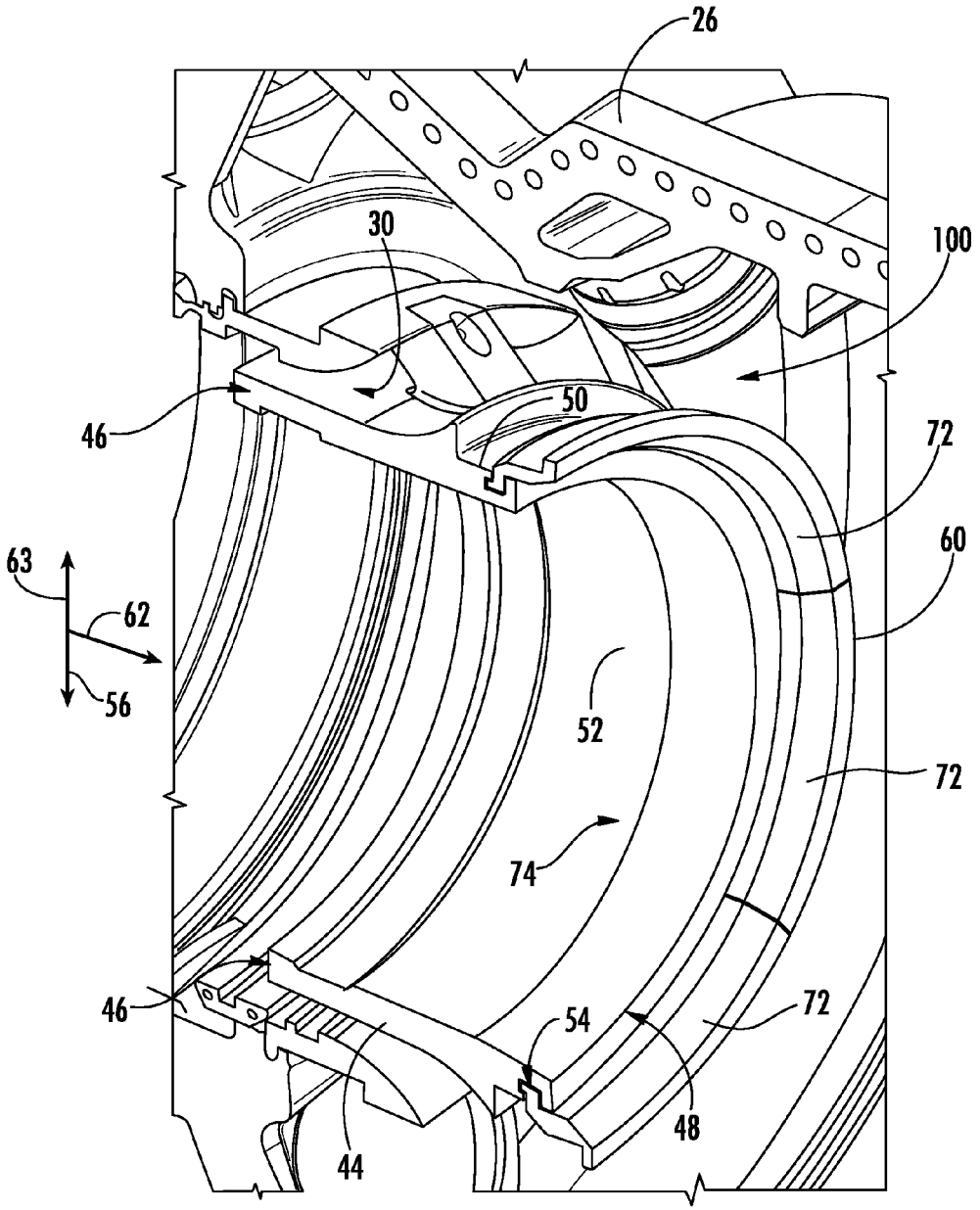
FIG. 3 provides a cross section perspective view of a portion of the gas turbine as shown in FIG. 2, according to one embodiment of the present invention.

FIG. 3 provides a cross section perspective view of a portion of the inner barrel 44 disposed within a portion of the compressor discharge casing 40 as shown in FIG. 2, according to at least one embodiment. As shown in FIG. 3, the inner barrel 44 includes an upstream or forward end 46, a downstream or aft end 48 that is axially separated from the forward end 46, an outer surface 50 that extends between the forward end 46 and the aft end 48 and an inner surface 52 radially separated from the outer surface 50. The inner surface extends between the forward end 46 and the aft end 48.

Figure 4:
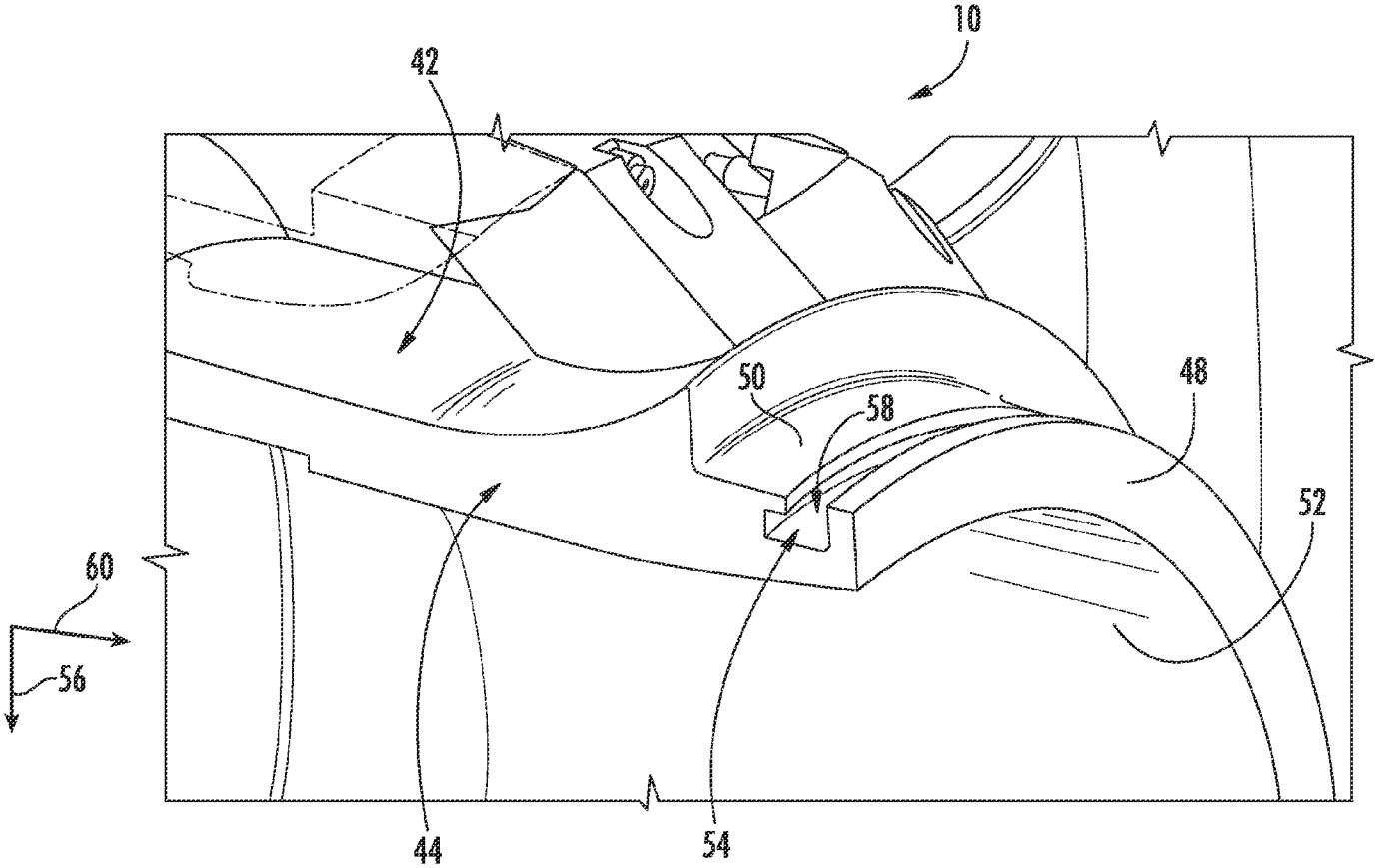
FIG. 4 provides an enlarged view of the portion of the gas turbine as shown in FIG. 3, according to one embodiment of the present invention.

FIG. 4 provides an enlarged view of a portion of the inner barrel 44 as shown in FIG. 3, according to one embodiment of the present invention. In one embodiment, as shown in FIGS. 2 and 4 a first fitting 54 is defined by the inner barrel 44. In particular embodiments, the first fitting 54 extends from the outer surface 50 in a radially inward direction 56 through the outer surface 50 towards the inner surface 52. In one embodiment, the first fitting 54 is disposed proximate to the aft end 48 of the inner barrel 44. As shown in FIG. 4, the first fitting 54 may extend circumferentially around at least a portion of the outer surface 50 of the inner barrel 44. In one embodiment, as shown in FIGS. 2 and 4, the first fitting 54 is a slot 58 defined within the inner barrel 44. The slot 58 is disposed between the inner surface 52 and the outer surface 50 and extends in the radially inward direction 56 through the outer surface 50 towards the inner surface 52.

As shown in FIG. 2, a nozzle support ring 60 extends in an axial direction 62 and in a radially outward direction 63 between the inner barrel 44 and the first stage 32 of turbine nozzles 34. In one embodiment, the nozzle support ring 60 extends in the axial direction 62 across a portion of the outer surface 50 of the inner barrel 44. The nozzle support ring 60 provides mounting support to the first stage 32 of turbine nozzles 34. As shown in FIG. 2, the nozzle support ring 60 includes a forward portion 64 and an aft portion 66.

A second fitting 68 is defined at the forward portion 64 of the nozzle support ring 60. The aft portion 66 is engaged with the first stage 32 of turbine nozzles 34. In particular embodiments, the second fitting 68 is seated within and/or engaged with the first fitting 54 to provide support to the nozzle support ring 60. In one embodiment, the second fitting 68 is complementary to the first fitting 54. For example, in one embodiment as shown in FIG. 2, the second fitting 68 is a tab 70 that is complementary to the slot 58. It should be known that the first fitting 54 may be any shape that is complementary to the second fitting 68 and that provides adequate support to the nozzle support ring 60 and should not be limited to a slot and tab shape.

Figure 5:
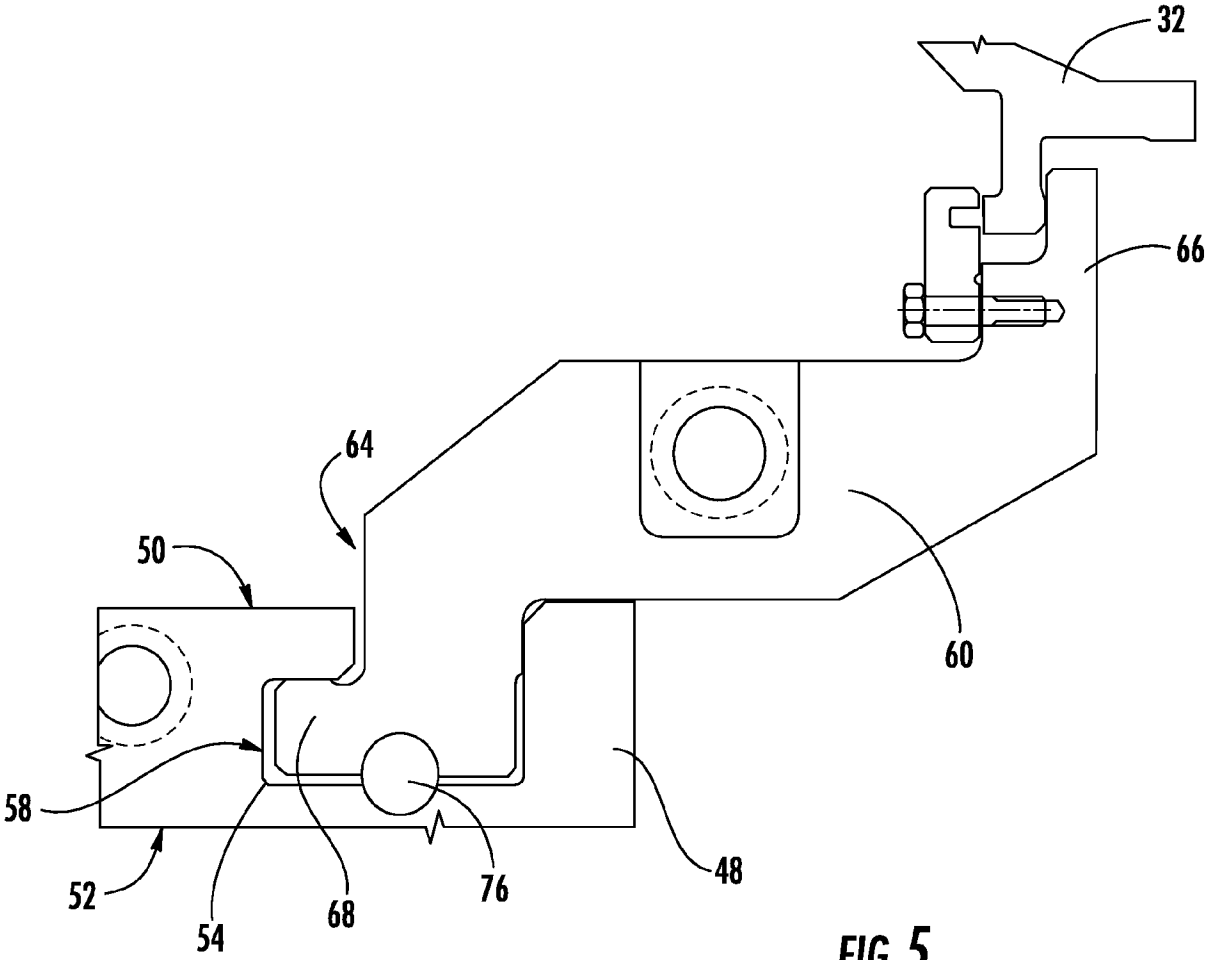
FIG. 5 provides an enlarged cross section side view of a portion of the gas turbine as shown in FIG. 2, according to one embodiment of the present invention.

FIG. 5 provides an enlarged cross section side view of a portion of the inner barrel 44, the nozzle support ring 60 and a portion of the first stage 32 of turbine nozzles 34 according to one embodiment of the present invention. As shown in FIG. 3, the nozzle support ring 60 may comprise of multiple semi-annular nozzle support ring segments 72 that are seated within the first fitting 54 defined in the inner barrel 44. As shown in FIG. 3, the inner barrel 44 may be split into semi-annular inner barrel sections 74 that are joined together during assembly and separated during disassembly of the compressor discharge casing 26 and/or the gas turbine 10. In one embodiment, as shown in FIG. 5, a locking pin 76 is provided between the first fitting 54 and the second fitting 68 to lock the multiple nozzle support rings 72 into position during assembly and disassembly of the gas turbine 10.

The various embodiments described herein and as illustrated in FIGS. 2, 3, 4 and 5 provide various technical benefits over existing first stage nozzle support schemes. For example, deleting a bolted connection between the nozzle support ring and the inner barrel reduces man hours for assembly and disassembly of the gas turbine, thereby potentially reducing assembly costs and reducing outage time. In addition, deleting the bolted connection reduces hardware costs. In addition, deleting a bolted connection allows for a shorter combustion section by allowing for a smaller axial distance between the diffuser exit from the inner barrel and the first stage of the stationary nozzles, thereby allowing for larger compressor sections and turbine sections which result in greater output from the gas turbine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for supporting a turbine nozzle, comprising:

an inner barrel having a forward end, an aft end, an inner surface and an outer surface that extends between the forward end and the aft end;

a slot defined within the inner barrel and extending circumferentially along and axially within the outer surface of the inner barrel, wherein the slot comprises a recess extending axially forward from the slot within the inner barrel; and a nozzle support ring having a forward portion and an aft portion, wherein the aft position is axially offset from the slot and the inner barrel, wherein the forward portion defines a tab that is complementary to and extends axially into the recess of the slot, and wherein the aft portion is coupled to a first stage of turbine nozzles.

2. The system as in claim 1, further comprising a locking pin that extends radially between the slot and the forward portion of the nozzle support ring.

3. The system as in claim 1, wherein the nozzle support ring comprises two or more semi-annular support ring sections.

4. A combustion section of a gas turbine, comprising:

a compressor discharge casing;

a turbine nozzle disposed within the compressor discharge casing;

an inner barrel disposed within the compressor discharge casing, the inner barrel being axially separated from the turbine nozzle within the compressor discharge casing, the inner barrel having a forward end, an aft end and an outer surface that extends between the forward end and the all end;

a slot defined by the inner barrel proximate to the aft end and extending circumferentially along and axially within the outer surface of the inner barrel, wherein the slot comprises a recess extending axially forward from the slot within the inner barrel;

a nozzle support ring having a forward portion and an aft portion axially spaced from the forward portion, the forward portion defining a tab that is complementary to the slot; and wherein the forward portion extends radially into the slot and the tab extends axially into the recess, wherein the aft portion is coupled to an inner band of the turbine nozzle.

5. The combustion section as in claim 4, wherein the tab is seated within the slot.

6. The combustion section as in claim 4, wherein the slot extends circumferentially around a diffuser casing.

7. The combustion section as in claim 4, further comprising a locking pin that extends radially between the slot and the tab of the nozzle support ring.

8. The system as in claim 1, wherein the nozzle support ring extends axially across a portion of the outer surface of the inner barrel.

9. A gas turbine, comprising:

a. a compressor;

b. a combustion section disposed downstream from the compressor;

c. a turbine disposed downstream from the combustion section;

d. a turbine nozzle disposed at an inlet to the turbine; and e. wherein the combustion section includes a compressor discharge casing that circumferentially surrounds a system for supporting the turbine nozzle, the system comprising:

i. an inner barrel that extends within the compressor discharge casing, the inner barrel being axially separated from the turbine nozzle, the inner barrel having a forward end, an aft end and an outer surface that extends between the forward end and the aft end;

ii. a slot defined by the inner barrel proximate to the aft end and extending circumferentially along the outer surface of the inner barrel, wherein the slot comprises a recess extending axially forward from the slot within the inner barrel;

iii. a nozzle support ring having a forward portion and an aft portion axially offset from the forward portion, the forward portion defining a tab that is complementary to the slot; and iv. wherein the forward portion extends radially into the slot and the tab extends axially into the recess, and wherein the aft portion is connected to an inner band of the turbine nozzle.

10. The gas turbine as in claim 9, wherein the tab is seated within the slot.

11. The gas turbine as in claim 9, further comprising a locking pin that extends radially between the slot and the tab.

12. The gas turbine as in claim 9, wherein the nozzle support ring extends axially across a portion of the outer surface of the inner barrel.

* * * * *